US008045718B2

(12) United States Patent
Faure et al.

(10) Patent No.: US 8,045,718 B2
(45) Date of Patent: Oct. 25, 2011

(54) METHOD FOR BINAURAL SYNTHESIS TAKING INTO ACCOUNT A ROOM EFFECT

(75) Inventors: Julien Faure, Lannion (FR); Alexandre Guerin, Rennes (FR); Rozenn Nicol, La Roche Derrien (FR); Gregory Pallone, Lannion (FR)

(73) Assignee: France Telecom, Paris (FR)

( * ) Notice: Subject to any disclaimer, the term of this patent is extended or adjusted under 35 U.S.C. 154(b) by 599 days.

(21) Appl. No.: 12/225,691

(22) PCT Filed: Mar. 8, 2007

(86) PCT No.: PCT/FR2007/050895

§ 371 (c)(1),
(2), (4) Date: Sep. 26, 2008

(87) PCT Pub. No.: WO2007/110520

PCT Pub. Date: Oct. 4, 2007

(65) Prior Publication Data

US 2009/0103738 A1 Apr. 23, 2009

(30) Foreign Application Priority Data

Mar. 28, 2006 (FR) ..... 06 02694

(51) Int. Cl.
*H04R 5/00* (2006.01)
*H04R 5/02* (2006.01)

(52) U.S. Cl. ..... 381/17; 381/310

(58) Field of Classification Search ..... 381/1, 17, 381/18, 63, 309, 310
See application file for complete search history.

(56) References Cited

U.S. PATENT DOCUMENTS

| | | | | |
|---|---|---|---|---|
| 5,438,623 | A | 8/1995 | Begault | |
| 5,459,790 | A | 10/1995 | Scofield | |
| 5,802,180 | A * | 9/1998 | Abel et al. | 381/17 |
| 6,307,941 | B1 | 10/2001 | Tanner, Jr. | |

FOREIGN PATENT DOCUMENTS

| | | | |
|---|---|---|---|
| JP | 11-503882 | T | 3/1999 |
| JP | 2001-516902 | | 10/2001 |
| JP | 2008-512015 | | 4/2008 |
| WO | WO 95/31881 | | 11/1995 |
| WO | WO 99/14739 | | 3/1999 |
| WO | WO 2006/024850 | A2 | 3/2006 |

OTHER PUBLICATIONS

S. Busson; "Individualization of acoustic indices binaural synthesis", Doctoral thesis from the Universite de la Mediterranee Aix-Marseille II, 2006 (Abstract).

D.R. Begault , et al.; "Direct comparison of the impact of head tracking, reverberation and individualized head-related transfer functions on the spatial perception of a virtual speech source", J. Audio Eng. Soc., vol. 49, No. 10, 2001.

D.J. Kistler , et al.; "A model of head-related transfer functions based on principal components analysis and minimum-phase reconstruction", J. Acoustic Soc. Am., 91 (3) pp. 1637-1647, 1992.

Kulkarni A., et al.; "On the minimum-phase approximation of head-related functions", 1995 IEEE ASSP Workshop on Applications of Signal Processing Audio and Acoustics (IEEE catalog No. 95TH8144).

* cited by examiner

*Primary Examiner* — Lex Malsawma

(74) *Attorney, Agent, or Firm* — McKenna Long & Aldridge LLP

(57) ABSTRACT

The invention concerns a method for three-dimensional spatialization of audio channels from a filter BRIR incorporating a theater effect. For a specific number N of samples corresponding to the size of the pulse response of the BRIR filter, it consists in breaking down (A) the BRIR filter into at least a set of delay and amplitude values associated with the times of arrival of reflections; extracting (B) on the number of B samples at least one spectral module of the BRIR filter; and constituting (C) from each successive delay, its amplitude and its spectral module associated with an elementary BRIR filter ($BRIR_e$) directly applied to the audio channels in the time, frequency or transformed domain. The invention is applicable to binaural or multichannel spatialization.

11 Claims, 3 Drawing Sheets

METHOD FOR BINAURAL SYNTHESIS TAKING INTO ACCOUNT A ROOM EFFECT

This application is a national stage entry of International Application No. PCT/FR2007/050895, filed on Mar. 8, 2007, and claims priority to French Application No. 06 02694, filed Mar. 28, 2006, both of which are hereby incorporated by reference as if fully set forth herein in their entireties.

BACKGROUND OF THE INVENTION

The invention relates to sound spatialization, known as 3D-rendered sound, of audio signals, integrating in particular a room effect, notably in the field of binaural techniques.

Thus, the term "binaural" is aimed at the reproduction on a pair of stereophonic headphones, or a pair of earpieces, of an audio signal but still with spatialization effects. The invention is not however limited to the aforementioned technique and is notably applicable to techniques derived from the "binaural" techniques, such as the "transaural" reproduction techniques, in other words on remote loudspeakers. TRANSAURAL® is a commercial trademark of the company COOPER BAUCK CORPORATION.

One specific application of the invention is, for example, the enrichment of audio contents by effectively applying acoustic transfer functions of the head of a listener to monophonic signals, in order to immerse the latter in a 3D sound scene, in particular including a room effect.

For the implementation of "binaural" techniques on headphones or loudspeakers, the transfer function, or filter, is defined for a sound signal between a position of a sound source in space and the two ears of a listener. The aforementioned acoustic transfer function of the head is denoted HRTF, for "Head-Related Transfer Function", in its frequency form and HRIR, for "Head-Related Impulse Response", in its temporal form. For one direction in space, two HRTFs are ultimately obtained: one for the right ear and one for the left ear.

In particular, the binaural technique consists of applying such acoustic transfer functions for the head to monophonic audio signals, in order to obtain a stereophonic signal which, when listened to on a pair of headphones, provides the listener with the sensation that the sound sources originate from a particular direction in space. The signal for the right ear is obtained by filtering the monophonic signal by the HRTF of the right ear and the signal for the left ear is obtained by filtering this same monophonic signal by the HRTF of the left ear.

The essential physical parameters that allow these transfer functions to be characterized are:

- the ITD, for "Interaural Time Difference", defined as the interaural arrival time difference of the sound waves from the same sound source between the left ear and the right ear of the listener. The ITD is principally linked to the phase of the HRTFs;
- the spectral modulus, which notably allows level differences to be perceived between the left ear and the right ear as a function of frequency;
- when the HRTF, or the HRIR, of the head of the listener are not considered as corresponding to conditions of free field sound propagation (anechoic condition), the aforementioned transfer functions can take into account reflection, scattering and diffraction phenomena which correspond to the acoustic response of the room in which these transfer functions have been measured or simulated. The aforementioned transfer functions are then called BRIR, for "Binaural Room Impulse Response", in their temporal form.

The aforementioned binaural techniques may for example be employed in order to simulate a 3D rendering of the 5.1 type on the pair of headphones. In this technique, to each loudspeaker position of the multi-speaker, or "surround", system corresponds an HRTF pair, one HRTF for the left ear and one HRTF for the right ear. The sum of the 5 channels of the signal in 5.1 mode, convoluted by the 5 HRTF filters for each ear of a listener, allows two binaural channels, right and left, to be obtained, which simulate the 5.1 mode for listening on a pair of audio headphones.

In this situation, binaural spatialization simulating a multi-speaker system is referred to as "binaural virtual surround".

In the 3D rendering, when the fact of the listener perceiving the sound sources at variable distances away from his head, a phenomenon known by the term 'externalization', is taken into account, and in a manner that is independent from the direction or origin of the sound sources, it frequently happens, in a binaural 3D rendering, that the sources are perceived to be inside the head of the listener. The source thus perceived is referred to as 'non-externalized'.

Various studies have shown that the addition of a room effect in the binaural 3D rendering methods allows the externalization of the sound sources to be considerably enhanced. Cf., notably, D. R. Begault and E. M. Wenzel, "*Direct comparison of the impact of head tracking, reverberation and individualized head-related transfer functions on the spatial perception of a virtual speech source*", J. Audio Eng. Soc., Vol. 49, No. 10, 2001.

Currently, there are two main methods allowing the room effect to be integrated into the HRIR:

- the first, relating to the real room effect, consists of measuring HRIRs in a non-anechoic room, therefore comprising a room effect. The HRIRs obtained, which are actually the BRIRs, must be of sufficiently long duration in order to integrate the first sound reflections, a duration longer than 500 time samples for a sampling frequency of 44,100 Hz, but this duration must be even longer, in other words longer than 20,000 time samples at the same sampling frequency, if it is desired to integrate the delayed reverberation effect. It is however noted that the aforementioned BRIRs may be obtained in an equivalent manner by the convolution of the HRIRs measured in an anechoic environment with the desired room effect, represented by the pulse response of the room;
- the second, relating to the artificial room effect, comes from virtual acoustics and consists of synthetically integrating the room effect into the HRIR. This operation is carried out thanks to spatializers that introduce artificial reverberation effects. The drawback of such methods is that obtaining a realistic rendering requires a significant processing power.

As far as "binaural" sound spatialization is concerned, a common method consists of modeling the binaural filters, by decomposing the HRTFs, or HRIRs, into a minimum-phase component (minimum-phase filter determined by the spectral modulus of the HRTF) and a pure delay. For a more detailed description of such a method, reference may usefully be made to the articles by D. J. Kistler and F. L. Wightman, "*A model of head-related transfer functions based on principal components analysis and minimum-phase reconstruction*", J. Acoustic Soc. Am., 91(3) pp. 1637-1647, 1992 and by Kulkarni A. et al. "*On the minimum-phase approximation of head-related functions*", 1995 IEEE ASSP Workshop on Applications of Signal Processing Audio and Acoustics (IEEE catalog number: 95TH8144).

The difference in delay observed between the HRTFs or the HRIRs of the left ear and of the right ear then correspond to the ITD localization index. Various methods exist for extracting the delays from the HRIRs or HRTFs. The main methods are described by S. Busson in "*Individualization of acoustic indices for binaural synthesis*", Doctoral thesis from the Université de la Méditerranée Aix-Marseille II, 2006.

The spectral modulus is obtained by taking the modulus of the Fourier transform of the HRIRs. The number of coefficients can then be reduced, for example by averaging the energy over a reduced number of frequency bands, for example according to the frequency smoothing techniques based on the integration properties of the auditory system.

Irrespective of the manner in which the HRTF, HRIR or, where appropriate, BRIR filters are modeled, several methods for implementation of binaural sound spatialization exist.

Amongst the latter, the simplest and most direct method is the dual-channel implementation of the binaural technique shown in FIG. 1.

According to this method, the spatialization of the sources is carried out independently from each other. One pair of HRTF filters is associated with each source. The filtering can be carried out either in the time domain, in the form of a convolution product, or in the frequency domain, in the form of a complex multiplication, or alternatively in any other transformed domain, such as for example the PQMF (Pseudo-Quadrature mirror Filter) domain.

Multi-channel implementation of the binaural technique is an alternative to dual-channel implementation offering a more efficient implementation that consists of a linear decomposition of the HRTFs, in the form of a sum of products of functions of the direction (encoding gains) and of elementary filters (decoding filters). This decomposition allows the encoding and decoding steps to be separated, the number of filters then being independent from the number of sources to be spatialized. The elementary filters may subsequently be modeled by a minimum-phase filter and a pure delay in order to simplify their implementation. It is also possible to extract the delays from the original HRTFs and to integrate them separately in the encoding.

The aforementioned prior art techniques exhibit major drawbacks, when BRIR filters are implemented, taking into account the room effect, in particular:

- the complexity: owing to the long duration of the room responses, the number of time samples contained in the BRIRs can be very high, greater than 20,000 samples for rooms of average size, this number being linked to the delay of the room echoes and therefore the dimensions of the latter. Consequently, the corresponding BRIR filters require a processing power and a memory size that are very large;
- externalization: the modeling in the form of a minimum-phase filter, associated with a pure delay, allows the size of the filters to be reduced. However, extracting a single interaural delay for each BRIR filter does not allow the first reflections to be taken into account. In this case, the sound timber is correctly adhered to but the externalization effect is no longer reproduced.

The object of the present invention is to overcome the aforementioned drawbacks of the prior art.

SUMMARY OF THE INVENTION

In particular, one subject of the present invention is a method for calculating modeling parameters for BRIR filters, or HRIR filters, taking into account a room effect from the prior art, these parameters comprising one or more delays which could be associated with gains and with at least one amplitude spectrum, in order to allow an effective implementation either in the time domain, or in the frequency or transformed domain.

Another subject of the present invention is the implementation of a method for calculating specific BRIR filters which, although equivalent in terms of quality to conventional or original BRIR filters allowing satisfactory positioning or externalization of the sources, greatly reduce the processing power and the memory size needed for the implementation of the corresponding filtering.

The audio channel 3D spatialization method, using at least one BRIR filter incorporating a room effect, subject of the present invention, is noteworthy in that it consists, for a specific number of samples corresponding to the size of the pulse response of the BRIR filter, at least of decomposing this BRIR filter into at least one set of delay and amplitude values associated with the arrival times of the reflections, of extracting over this number of samples at least one spectral modulus, and of forming from each successive delay, from its associated amplitude and from its associated spectral modulus, an elementary BRIR filter directly applied to the audio channels in the time, frequency or transformed domain.

The method, subject of the invention, is also noteworthy in that the decomposition of the BRIR filter is carried out by a process for detecting the delays by detection of the amplitude peaks, the delay corresponding to the moment of arrival of the direct sound wave being associated with the first amplitude peak.

The method, subject of the invention, is also noteworthy in that the extraction of each spectral modulus is carried out by a time-frequency transformation.

The method, subject of the invention, is also noteworthy in that, for a number of samples corresponding to the pulse response of the BRIR filter decomposed into frequency sub-bands of given rank k, the value of the spectral modulus of the BRIR filter is defined as a real gain value representative of the energy of the BRIR filter within each sub-band.

The method, subject of the invention, is also noteworthy in that a spectral modulus is associated with each delay and in that the spectral modulus of the BRIR filter is defined in each sub-band as a real gain value representative of the energy of the partial BRIR filter in said sub-band, this gain value being a function of the associated delay.

This modulation of the spectral modulus as a function of the applied delay allows a reconstruction of the BRIR filter to be implemented that is much closer to the original BRIR filter.

Lastly, the method, subject of the invention, is noteworthy in that each elementary BRIR filter in each frequency sub-band of rank k is formed by a complex multiplication, which may or may not be a function of the delay associated with each amplitude peak including a real gain value, and by a pure delay, increased by the delay difference with respect to the delay allocated to the first sample corresponding to the arrival time of the direct sound wave.

BRIEF DESCRIPTION OF THE DRAWINGS

It will better understood upon reading the description and observing the drawings hereinafter, aside from FIG. 1 relating to a technique for binaural sound spatialization from the prior art.

DESCRIPTION OF PREFERRED EMBODIMENTS

The audio channel 3D spatialization method using at least one BRIR filter incorporating a room effect, according to the subject of the invention, will now be described in conjunction with FIG. 2 and the following figures.

The method, subject of the invention, consists, for a specific given number N of samples, corresponding to the size of the pulse response of the BRIR filter, of decomposing, in a step A, this BRIR filter into at least one set of amplitude values and of delay values describing a series of amplitude peaks.

Figure 2:
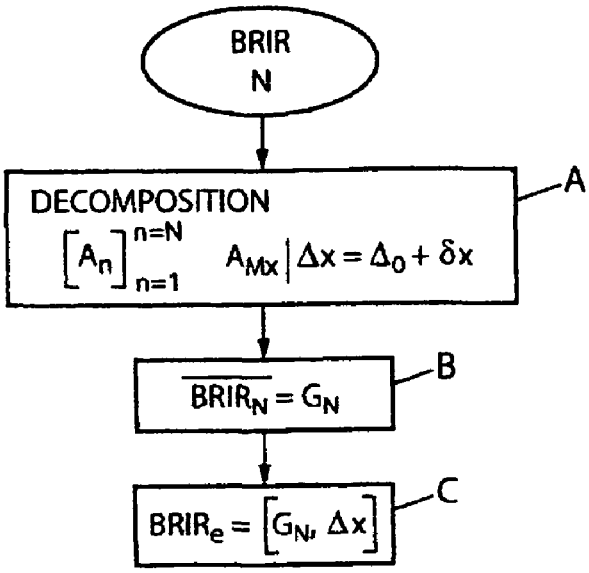
FIG. 2 shows, purely by way of illustration, a flow diagram of the essential steps for implementation of the audio channel 3D spatialization method using at least one BRIR filter incorporating a room effect, according to the subject of the present invention.

Step A in FIG. 2, the decomposition operation is denoted:

$$[A_n, n]_{n=1}^{n=N} A_{Mx} | \Delta x = \Delta_0 + \delta x.$$

In this equation, $A_n$ indicates the amplitude of the sample of rank n and $A_{Mx}$ indicates the amplitude of each amplitude peak, Δx denoting the delay associated with each of the corresponding amplitude peaks.

This delay is a function of the delay $\Delta_0$ corresponding to the arrival time of the direct wave as will be described hereinafter in the description. The step A is followed by a step B consisting of extracting, over the number N of samples, at least one mean spectral modulus of the BRIR filter, each spectral modulus being denoted:

$$\overline{BRIR_N} = G_N.$$

The step B is then followed by a step C consisting of forming, from each successive delay, from the amplitude and from the spectral modulus associated with this delay established at the step B, an elementary BRIR filter denoted $BRIR_e$ directly applied to the audio channels in the time, frequency or transformed domain, as will be described hereinafter in the description.

More specifically, it will be understood that the decomposition of the BRIR filter at the step A is carried out by a process of detection of the delays by detection of the amplitude peaks, the delay $\Delta_0$ corresponding to the arrival time of the direct sound wave being associated with the first amplitude peak.

Thus, the first amplitude peak is defined by the parameters $A_{M0} | \Delta_0$.

It will also be understood that, aside from the delay $\Delta_0$, a value δx depending on the position of the amplitude peak in the N samples is then successively associated with the other amplitude peaks, the delay allocated to each amplitude peak $A_{Mx}$ being given by $\Delta x = \Delta_0 + \delta x$.

Other methods for detecting the first peak may also be used, as is known from the prior art, in particular for determining the value of the delay $\Delta_0$ which can for example be taken equal to the interaural delay.

The step B, for extracting at least one spectral modulus of the BRIR filter with a duration of N samples allows a correspondence of the timber to be ensured between each original BRIR filter and the BRIR filter reconstructed using the elementary filters $BRIR_e$, as will be described later on in the description.

In particular, and in a non-limiting manner, the extraction of the spectral modulus can be carried out by a time-frequency transformation such as a Fourier transform, as will be described later on in the description.

The implementation of the elementary BRIR filters $BRIR_e$, each formed from the value of each spectral modulus of the BRIR filter and of course from the amplitude and from the delay Δx in question, allows a reduction in the processing costs to be realized.

All the methods for filtering based on a minimum-phase filter or otherwise, associated with all the methods for implementing the delays, can be suitable for the proposed decomposition. In particular, the method, subject of the invention, can for example be combined with a multichannel implementation of the binaural 3D spatialization.

One particular preferred non-limiting embodiment of the method, subject of the invention, will now be described in conjunction with FIGS. 3*a* to 3*d*.

The aforementioned embodiment is implemented in the framework of the decomposition of BRIR filters for an efficient implementation in the domain of the complex temporal sub-bands more particularly, but in a non-limiting manner, the complex PQMF domain.

Such an implementation can be used by a decoder defined by the MPEG surround standard in order to obtain a binaural 3D rendering of the 5.1 type. The 5.1 mode is defined by the MPEG spatial audio coding standard ISO/IEC 23003-1 (doc N7947).

With reference to the French patent application entitled:

"*Method and device for efficient binaural sound spatialization in the transformed domain*", filed the same day in the name of the applicant, it is stated that the binaural filtering can be carried out directly in the domain of the sub-bands, in other words in the coded domain, in order to reduce the decoding costs including the implementation of the method.

The aforementioned embodiment may be transposed into the time domain, in other words into the domain not transformed into sub-bands, or into any other transformed domain.

The method, subject of the invention, in a general manner and in particular in its preferred embodiment, allows the following to be obtained:

- delays that correspond to the delay $\Delta_0$, arrival time of the direct sound wave, and to the delays of the first reflections from the room, these delays then being implemented in the domain of the sub-bands;
- gain values, being real values, a gain being for example assigned to each sub-band and for each reflection based on the spectral content of the BRIR filters, as will be detailed hereinafter.

Figure 1:
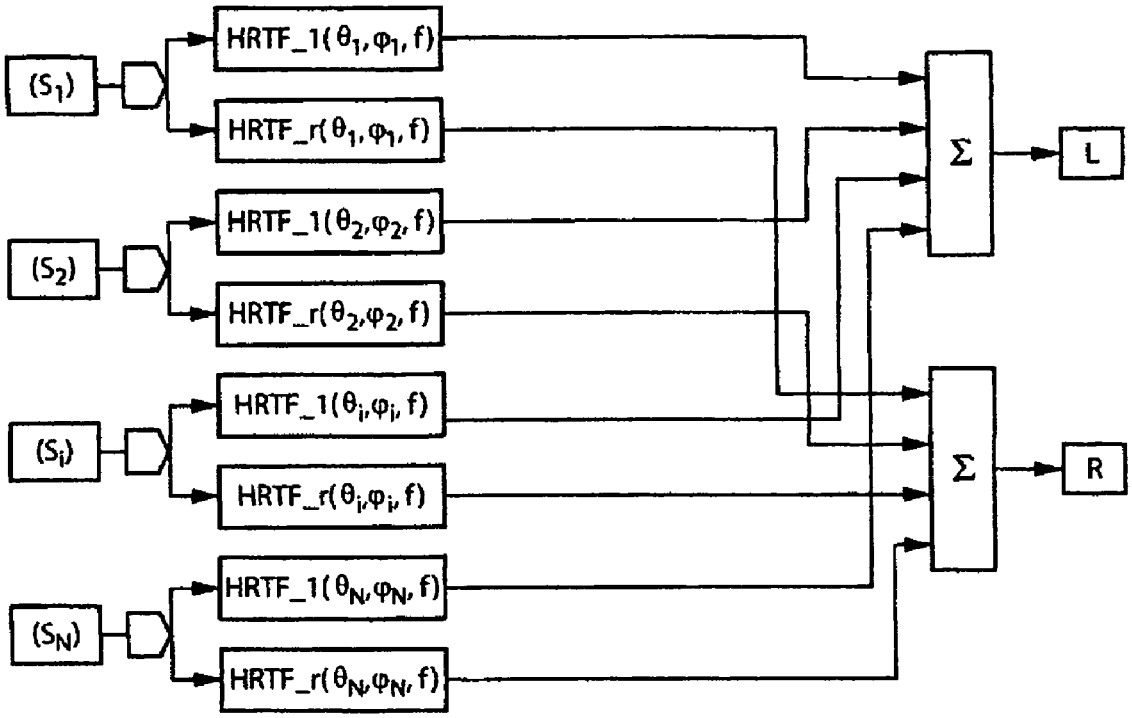
FIG. 1 (PRIOR ART)
Figure 3D:
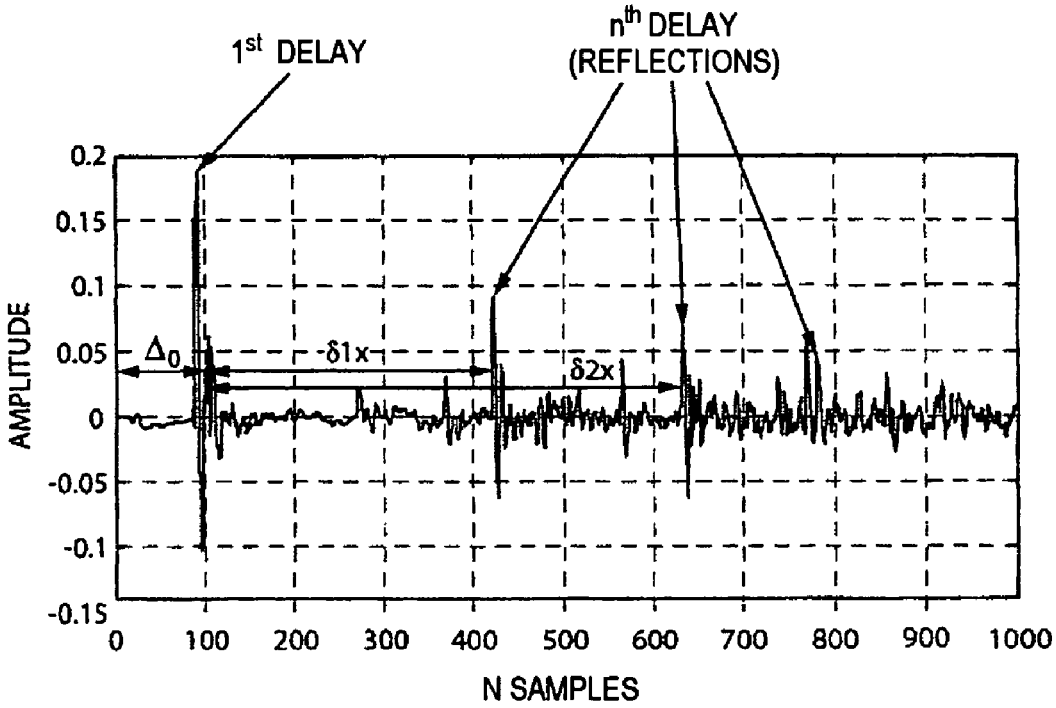
FIG. 3*d* shows a timing diagram of the amplitude peaks representative of the first reflections due to the room effect obtained from the second vector illustrated in FIG. 3*c*, a delay corresponding to the parameter corresponding to the arrival time of the direct sound wave, then specific successive delays added to the direct sound wave delay parameter being allocated to each of the first reflections.
Figure 3A:
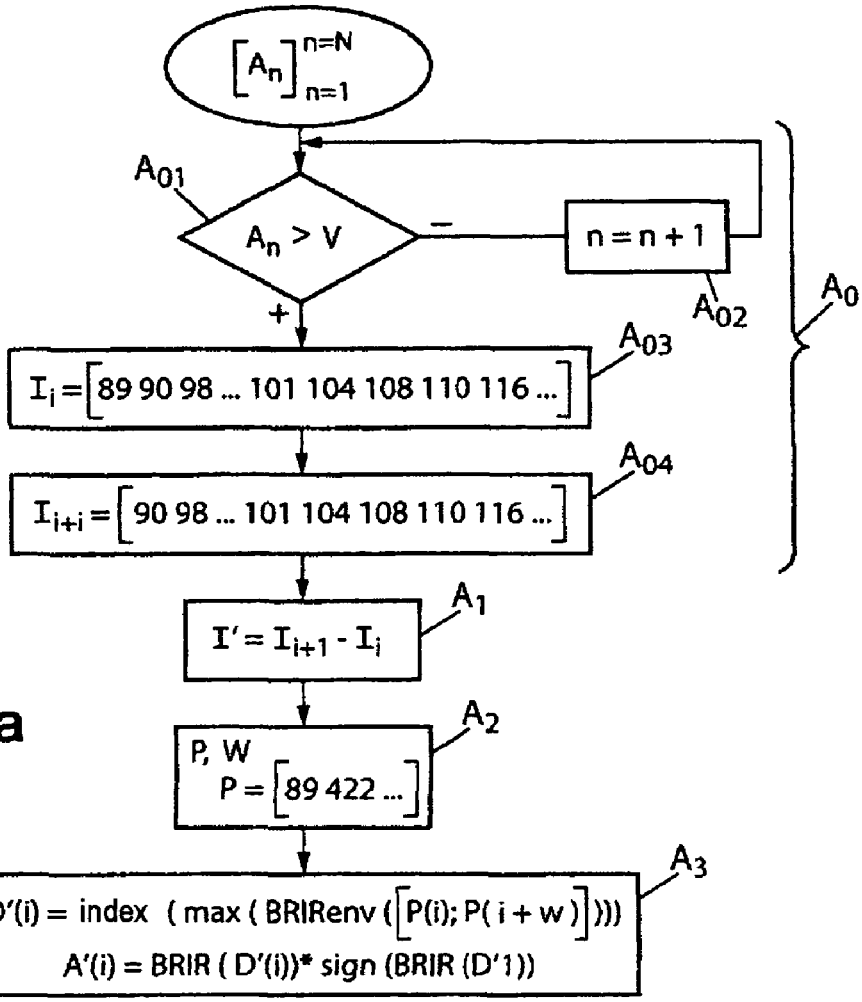
FIG. 3*a* shows an implementation detail of the decomposition step executed at the step A in FIG. 2*a;*

Thus, for an execution described by way of non-limiting example in the domain of the complex temporal sub-bands, the extraction of the delays consists, for any BRIR filter corresponding to a position in space, as is shown in FIG. 3*a* and based on the temporal envelope of the filter established over the number of samples N corresponding to the size of the pulse response of the BRIR filter, this temporal envelope being denoted $[A_n]_{n=1}^{n=N}$, at least of carrying out a first sub-step, denoted $A_0$, consisting of identifying the indices of rank of a time sample whose amplitude value is higher than a threshold value denoted V at the step $A_{01}$ in FIG. 3*a*. It will, in particular, be understood that the comparison $A_0 > V$ is carried out for each sample from the N samples successively by returning to the step $A_{01}$ via the sub-step $A_{02}$ successively over the N samples.

This operation allows a first vector denoted $I_i$ to be generated at the sub-step $A_{03}$, and a first offset vector denoted $I_{i+1}$ at the sub-step $A_{04}$. The first vector $I_i$ corresponds to the indices of rank of the time samples whose amplitude value is higher than the value of the threshold V. The first offset vector $I_{i+1}$ is deduced from the first vector by offsetting by one index. The first vector and the first offset vector are representative of the position of the amplitude peaks in the number N of samples.

The step $A_0$ is followed by a step $A_1$ consisting of determining whether the time samples whose amplitude is higher than the threshold value V correspond to isolated amplitude peaks by calculation of a difference vector I' which represents the difference between the first offset vector $I_{i+1}$ and the first vector I.

Indeed, it will be understood that, if the values contained within the difference vector I' are large, then this indicates the presence of a peak distinct from the preceding peak, as will be described later on in the description.

The step $A_1$ is then followed by a step $A_2$ consisting of calculating a second vector P grouping the indices of isolated amplitude peaks over the number N of samples for a difference threshold defined by a specific value W.

Lastly, the step $A_2$ is followed by a step $A_3$ consisting of identifying, from the samples of the second vector, for each isolated peak identified, the index of the sample of maximum amplitude from amongst a given number of samples, taken equal to the value W mentioned previously, following the sample identified by the second vector. This value W may be determined experimentally.

The index and the amplitude of any new maximum amplitude sample are stored in the form of a delay index vector and of an amplitude vector.

Thus, at the end of the step $A_3$, all of the delay index and amplitude values of the aforementioned amplitude peaks are for example available in the form of a vector of index D'(i) and of a vector of amplitude A'(i).

Figure 3B:
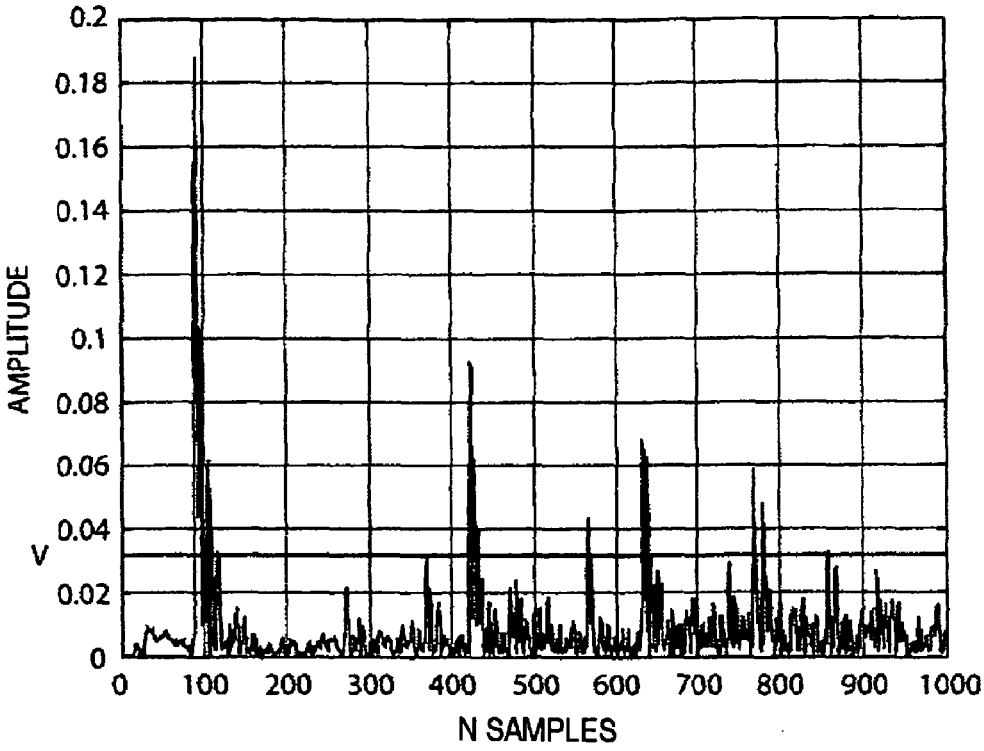
FIG. 3*b* shows a sample timing diagram allowing the mode of operation to be detailed in a sub-step $A_0$ for forming a first vector $I_i$ and a first offset vector $I_{i+1}$ of amplitude peaks in FIG. 3*a;*
Figure 3C:
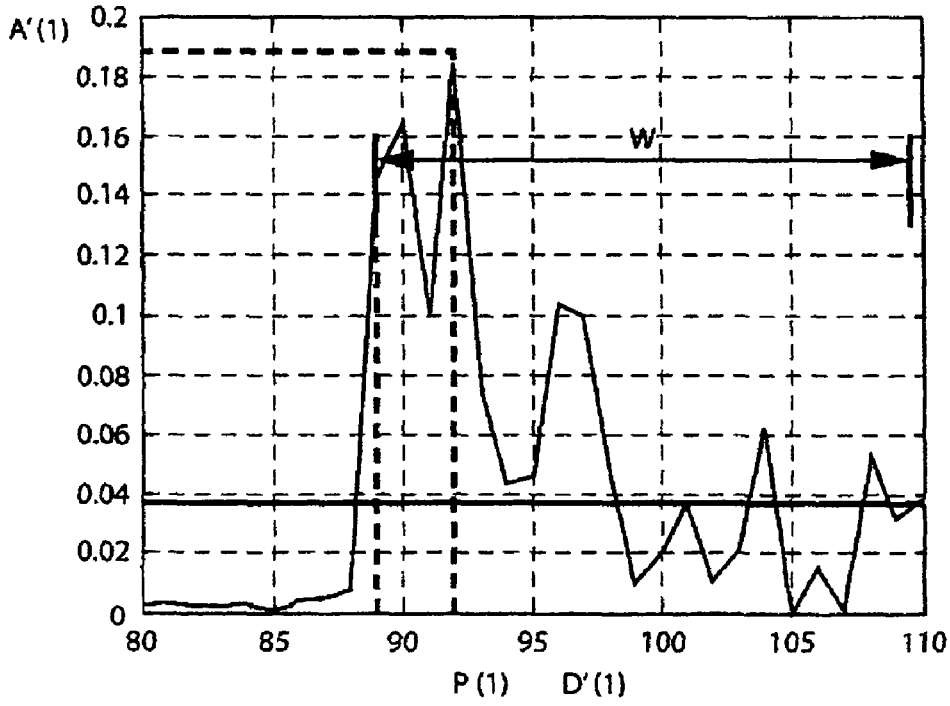
FIG. 3*c* shows, by way of illustration, a timing diagram of the samples of amplitude peaks detailing a process for constructing a second vector starting from a difference vector between the first offset vector and first vector illustrated in FIG. 3*b*, this second vector grouping the rank indices of the isolated amplitude peaks.

A specific description of the implementation of the steps $A_0$, $A_1$, $A_2$ and $A_3$ shown in FIG. 2 will now be presented in conjunction with FIGS. 3*b*, 3*c* and 3*d*.

With reference to FIG. 3*b*, for a BRIR temporal filter corresponding to a position in space, the temporal envelope of the latter is given by:

$$BRIR_{env}(t)=|BRIR(t)|.$$

The step $A_0$ then consists of finding all the indices of the samples whose envelope value is greater than the threshold value V.

In a particularly advantageous manner and according to one noteworthy aspect of the method, subject of the invention, the threshold value V is itself a function of the energy of the temporal envelope of the BRIR filter.

Thus, the threshold value V advantageously verifies the equation:

$$V = C\sqrt{\frac{\sum_N BRIR(t)^2}{N}}$$

In the preceding equation, apart from N representing the number of time samples, C is a constant fixed at 1 for example.

Following the comparisons carried out in steps $A_{01}$ and $A_{02}$, upon successful comparison, the values are stored in a vector $I_i$ of dimension K, K being the number of samples whose absolute amplitude value exceeds the threshold value V in order to form the first vector.

By way of non-limiting example, in FIG. 3*b*, the temporal envelope of a BRIR filter is shown for which the threshold V is fixed at the real value 0.037.

The vector $I_i$ shown at the step $A_{03}$ in FIG. 3*a* is written:

$$I_i=[89\ 90\ 91\ 92\ 93\ 94\ 95\ 96\ 97\ 98\ 101\ 104\ 108\ 110\ 116\ 422\ 423\ 424\ 427\ \ldots].$$

Starting from the storage of the vector $I_i$, by shifting the index of the first amplitude peak, the index 89, the offset vector $I_{i+1}$ is also stored, the vector $I_{i+1}$ corresponding for example to the vector $I_i$ in which the first amplitude peak has been eliminated.

The first vector $I_I$ and the first offset vector $I_{i+1}$ are thus now available.

At the step $A_1$, the vector I', the difference vector, is then calculated as the difference between the first offset vector $I_{i+1}$ and the first vector $I_i$.

In the example given, the difference vector I' verifies the equation:

$$I'=[1\ 1\ 1\ 1\ 1\ 1\ 1\ 1\ 1\ 3\ 3\ 4\ 2\ 6\ 306\ 1\ 1\ 3\ \ldots].$$

The high values contained within the vector I' indicate the presence of an amplitude peak distinct from the preceding amplitude peak.

The step $A_2$ then consists of calculating the second vector P which groups the indices of the separate peaks.

In the example given, the first peak P(1) is of course given by P(1)=I(1)=89, in other words by the first amplitude peak previously mentioned. The index of the following peaks corresponds to the indices increased by 1 of the values of I' that exceed a difference threshold defined by a value W. By way of non-limiting example and experimentally, W can be fixed at the value 20. In this scenario, the value I'(15)=306>W determines a second isolated peak. The value of the index of rank of this second peak P(2) is then given by I(15+1)=422.

Thus, the second vector P may be written in the form:

$$P=[89\ 422\ \ldots].$$

As is shown in FIG. 3*c*, the step $A_3$ in FIG. 3*a* can consist, starting from each of the samples P(i) of the second vector representative of the temporal envelope, of finding the sample that has the maximum amplitude value amongst the W=20 samples following.

The index of this new sample is stored in the vector D' and its amplitude is stored in the vector A' as is mentioned in conjunction with the step $A_3$ in FIG. 3*a* according to the equations:

$$D'(i)=\text{index}(\max(BRIR_{env}([P(i);P(I+W)]))),$$

$$A'(i)=BRIR(D'(i))*\text{sign}(BRIR(D'(1))).$$

In a non-limiting manner for the example given in conjunction with FIG. 3:

$$D'=[92\ 423\ \ldots],$$

$$A'=[0.1878\ 0.0924\ \ldots].$$

If the amplitude of the first maximum amplitude sample denoted A(1) is negative, then the absolute value of the latter is used.

The amplitudes A of the maximum amplitudes can then be normalized in energy by the equation:

$$A = \frac{A'}{\sqrt{\sum_{l=1;L} A'(l)^2}}$$

In the preceding equation, L is the number of elements of D' and of A, in other words index and amplitude vectors representative of each peak. This number of course depends on the threshold value V and on the value of the aforementioned constant W.

A representation of the normalized amplitudes, of the amplitude peaks and of their successive delay position, with respect to the first amplitude peak to which the delay $\Delta_0$ is assigned, is shown in FIG. 3*d*.

A more detailed description of a first and of a second embodiment of the elementary BRIR filters, directly applicable and applied to the audio channels in the transformed domain, in particular in the complex PQMF domain decomposed into sub-bands $SB_k$, will be presented by way of non-limiting example hereinafter in the description.

It is recalled that the decomposition into sub-bands in the aforementioned domain allows the N samples of the pulse response of the BRIR filter to be decomposed into M frequency sub-bands, for example M=64, for an application in the aforementioned MPEG surround standard.

The advantage of such a transformation is to be able to apply real gains to each sub-band, while avoiding the problems of spectral aliasing generated by the under-sampling inherent to the bank of filters.

In the domain of the aforementioned sub-bands, the delays and the gains are applied to the complex samples, as will be described later on in the description.

According to a first non-limiting embodiment, the value of each spectral modulus of the BRIR filter is defined in each sub-band as at least one real gain value representative of the energy of the BRIR filter in said sub-band.

In this first embodiment, the corresponding gain values denoted G(k,n), where k denotes the rank of the sub-band in question and n the rank of the sample amongst the N samples, are obtained by averaging the energy of the spectral amplitude of each BRIR filter in each sub-band.

For a BRIR frequency filter BRIR*(f) corresponding to the Fourier transform with 8,192 samples of the temporal filter BRIR(t), completed by 0s in order to obtain the 8,192 samples, the value of the gains G(k,n) is given by the equation:

$$G(k, n) = \sqrt{\frac{\sum_{f=f1}^{f=f1+M'} (H(f)BRIR*(f))^2}{M'}}$$

In the preceding equation, it is stated that H is a weighting window, for example a rectangular window of width M' greater than or equal to the width of the sub-band $SB_k$; for example M'=64. The weighting window is centered on the central frequency of the sub-band k and the frequency f1 is lower than or equal to the starting frequency of the sub-band k.

According to a second preferred embodiment of the method, subject of the invention, a spectral modulus is associated with each delay. The value of each spectral modulus is defined in each sub-band as at least one gain value representative of the energy of the partial BRIR filter in said sub-band, this gain value being a function of the delay applied as a function of the index of each amplitude peak sample, based on the index and amplitude vector.

Thus, in this second embodiment, the gains G(k,n) are modulated and can therefore vary at each new delay I applied. The gain values are then given by the equation:

$$G(k, n, l) = \sqrt{\frac{\sum_{f=f1}^{f=f1+M'} (H(f)BRIR*(f, l))^2}{M'}}$$

In the preceding equation, BRIR*(f,l) is the Fourier transform of the temporal filter BRIR(t) windowed between the samples D'(1)−Z and D'(1+1), the calculated spectral energy being that of the partial BRIR filter thus windowed, and completed by 0s in order to obtain 8,192 samples. Z depends on the sampling frequency and can take the value Z=10 for a sampling frequency at 44.1 kHz.

The aforementioned second embodiment is noteworthy in that it allows a reconstruction that is very much closer to the original transfer function or BRIR filter and, in particular, each of the delays caused by the successive reflections in the room to be taken into account, which allows a particularly effective and realistic rendering of the room effect to be obtained.

It will then be understood that each elementary BRIR filter, in each frequency sub-band k, can then be advantageously formed by a complex multiplication, including a real gain value, which may or may not be a function of the delay applied as a function of the index of each amplitude peak sample, according to the first or the second embodiment chosen, previously described in the description.

The complex multiplication operation is given by the equation:

$$S'(k, n) = G(k, n)A(l)e^{-j\pi\frac{(k+0.5)d(l)}{M}}E(k, n).$$

The elementary BRIR filter is also formed by a pure delay increased by the delay difference with respect to the delay $\Delta_0$ allocated to the first amplitude peak.

This delay can then be implemented by means of a delay line applied to the product obtained by the aforementioned rotation in the form of a complex multiplication.

The sample obtained then verifies the equation:

$$S(k,n)=S'(k,n-D(l)).$$

In the preceding equations, E(k,n) denotes the n-th complex sample of the sub-band k in question, S(k,n) denotes the n-th complex sample of the sub-band k after application of the gains and of the delays, M is the sub-band number and d(l) and D(1) are such that they correspond to the application of the l-th delay of D(l)M+d(1) samples in the non-under-sampled time domain.

The delay D(1)M+d(l) corresponds to the values of D'(l) calculated according to the amplitude peak detection process previously described in conjunction with FIGS. 3*a* to 3*d*.

In addition, A(l) denotes the amplitude of the peak associated with the corresponding delay and G(k,n) denotes the real gain applied to the n-th complex sample of the sub-band $SB_k$ of rank k in question.

Lastly, the method, subject of the invention, allows the delayed reverberation to be processed. It is recalled that delayed reverberation corresponds to the part of the response of a room for which the acoustic field is diffused and, as a result, the reflections are not discernable. It is however possible for the room effects to be processed including a delayed reverberation, in accordance with the method, subject of the invention. For this purpose, the method according to the invention consists of adding to the values of amplitude peaks detected a plurality of arbitrary amplitude values distributed beyond an arbitrary moment in time starting from which it is considered that the discrete reflections have ended and where the delayed reverberation phenomena begins. These amplitude values are calculated and distributed beyond the arbitrary period of time, which may be taken equal to 200 milliseconds for example, up to the last sample from the number of samples corresponding to the size of the BRIR pulse response.

Thus, in accordance with the method, subject of the invention, the amplitude peaks of the first reflections are determined as was previously described in conjunction with FIG. 2 and subsequent figures, and, starting from a sample t1 corresponding to 200 milliseconds, determined experimentally and corresponding to the start of the delayed reverberation, up to a sample t2 which corresponds to the end of the reverberation or, as the case may be, to the end of the N samples of the pulse response of the BRIR filter, R values are added to the vectors D' and A' such that:

$$D'(L+r)=t1+(t2-t1)/(R-1),$$

$$A(L+r)=1.$$

In the preceding equation, L is the number of peaks detected, and r is an integer in the range between 1 and R.

Using the aforementioned second embodiment, in which the gain values are modified as a function of the delay of each amplitude peak, then allows the delayed reverberation to be introduced efficiently into the domain of the sub-bands.

The delayed reverberation phenomenon may also be processed by a delay line added to the processing of the first reflections.

Lastly, the invention covers a computer program comprising a series of instructions, stored on a storage medium of a computer or of a device dedicated to the 3D sound spatialization of audio signals, which is noteworthy in that, when it is executed, this computer program executes the 3D sound spatialization method using at least one BRIR filter comprising a room effect as previously described in the description in conjunction with FIGS. 2 and 3*a* to 3*d*.

In will be understood, in particular, that the aforementioned computer program can be a directly executable program installed into the non-volatile memory of a computer or of a device for binaural synthesis of a room effect in sound spatialization.

The implementation of the invention can then be carried out in a completely digital manner.

The invention claimed is:

1. A method for 3D spatialization of audio channels, using at least one acoustic filter transfer function incorporating a room effect, the method comprising, for a specific number of samples corresponding to a size of a pulse response of the transfer function, the steps of:

decomposing the transfer function into at least one set of delay and amplitude values associated with amplitude peak values;

extracting from the number of samples at least one spectral modulus of the transfer function; and forming from each successive delay, from its associated amplitude and from its associated spectral modulus, an elementary transfer function directly applied to the audio channels in the time, frequency, or transformed domain.

2. The method as claimed in claim 1, wherein the decomposition of the transfer function is carried out by a process of detection of a delay by detection of amplitude peaks, the delay corresponding to the time of arrival of a direct sound wave associated with a first amplitude peak.

3. The method as claimed in claim 1, wherein the extraction of each spectral modulus is carried out by a time-frequency transformation.

4. The method as claimed in claim 1, wherein the extraction of the delays comprises, for any transfer function corresponding to a position in space, based on a time envelope of the transfer function established over the number of samples corresponding to the size of the pulse response of the transfer function, the steps of:

identifying indices having a rank of time samples whose amplitude value is higher than a threshold value, in order to generate a first vector and a first offset vector representative of the position of the amplitude peaks in the number of samples;

determining the existence of isolated amplitude peaks by calculation of a difference vector between the first offset vector and the first vector;

calculating a second vector grouping the indices of the isolated amplitude peaks over the number of samples;

discriminating, using the samples of the second vector, the successive indices of samples of maximum amplitude from amongst a given number of successive samples, the index and the amplitude of the samples of maximum amplitude being stored in the form of a delay and amplitude index vector.

5. The method as claimed in claim 1, wherein, for a number of samples corresponding to the pulse response of the transfer function decomposed into frequency sub-bands of given rank k, the value of the spectral modulus of the transfer function is defined as a real gain value representative of the energy of the transfer function in each sub-band.

6. The method as claimed in claim 5, wherein the value of the spectral modulus of the transfer function in each sub-band is calculated by application of a weighting window centered on the central frequency of the frequency sub-band of rank k and of width equal to or greater than the width of the frequency sub-band.

7. The method as claimed in claim 5, wherein a spectral modulus is associated with each delay, and the spectral modulus is defined in each sub-band as a real gain value representative of the energy of the partial transfer function in the sub-band, which gain value is a function of the associated delay.

8. The method as claimed in claim 5, wherein each elementary transfer function in each frequency sub-band of rank k is formed by:

a complex multiplication, which may or may not be a function of the applied delay depending on the index of each amplitude peak sample including the real gain value; and a pure delay, increased by the delay difference with respect to the delay allocated to the first sample corresponding to the arrival time of the direct sound wave.

9. The method as claimed in claim 1, wherein, for processing of a delayed reverberation, the method further comprises the step of adding to the detected amplitude peak values a plurality of arbitrary amplitudes, distributed, from an arbitrary moment in time, up to the last sample of the numbers of samples corresponding to the size of the pulse response of the transfer function.

10. A computer program comprising a series of instructions stored on a storage medium of a computer or a dedicated device for 3D sound spatialization of audio signals, wherein, during its execution, the program executes the method of 3D sound spatialization using at least one acoustic filter transfer function comprising a room effect, as claimed in claim 1.

11. The method as claimed in claim 1, wherein the delay and amplitude values associated with peak values correspond to arrival times of reflections.

* * * * *